United States Patent [19]

Sung et al.

[11] Patent Number: 4,775,389

[45] Date of Patent: Oct. 4, 1988

[54] EXHAUST PARTICULATE REDUCING AND COLOR STABILIZING ADDITIVES FOR DIESEL FUELS

[75] Inventors: Rodney L. Sung, Fishkill; Antonio M. Mourao, Newburgh, both of N.Y.

[73] Assignee: Texaco Inc., White Plains, N.Y.

[21] Appl. No.: 947,073

[22] Filed: Dec. 29, 1986

[51] Int. Cl.[4] ..... C10L 1/22; C10L 1/30

[52] U.S. Cl. ..... 44/63; 44/56; 44/57; 44/59; 44/68

[58] Field of Search ..... 44/59, 63, 57

[56] References Cited

U.S. PATENT DOCUMENTS

| | | | |
|---|---|---|---|
| 3,640,928 | 2/1972 | Murayama et al. | 546/188 |
| 3,844,957 | 10/1974 | Robinson | 44/63 |
| 4,396,769 | 8/1983 | Ferreira et al. | 546/188 |
| 4,514,226 | 4/1985 | Leoffler | 44/59 |
| 4,522,631 | 6/1985 | Mourao et al. | 44/68 |

FOREIGN PATENT DOCUMENTS

| | | |
|---|---|---|
| 56-185898 | 11/1981 | Japan . |
| 57-123013 | 7/1982 | Japan . |

*Primary Examiner*—William R. Dixon, Jr.
*Assistant Examiner*—Ellen McAvoy
*Attorney, Agent, or Firm*—Robert A. Kulason; James J. O'Loghlin

[57] ABSTRACT

Diesel fuel oil of improved color stability containing a bis-nitrogen heterocyclic diester, a rare earth metal and an oxygenated compound.

8 Claims, No Drawings

EXHAUST PARTICULATE REDUCING AND COLOR STABILIZING ADDITIVES FOR DIESEL FUELS

FIELD OF INVENTION

This invention relates to middle distillate fuel oils. More particularly, it is related to middle distillate fuel oils characterized by color stabilization.

BACKGROUND OF INVENTION

This invention relates to a process of color stabilization of a diesel fuel containing rare earth metals and oxygenated compounds which effectively reduce exhaust emissions of diesel fueled internal combustion engines and, more particularly, to the use of rare earth metal compounds to reduce the amount of particulates in diesel engine exhaust emissions.

Diesel fueled internal combustion engines give off particulates in the exhaust which may be harmful pollutants. These particulates are both particles seen as visible smoke and also are those particles which are invisible but still present in the diesel exhaust. The Federal Environmental Protection Agency has recently determined that diesel powered automobiles emit unacceptably high levels of air pollution and the levels of particulate emissions must be reduced to about 0.2 gram per mile by 1985. Presently most diesel engines used in automobiles will probably exceed this limit.

DISCLOSURE STATEMENT

1. U.S. Pat. Nos. 2,926,454; 3,410,670 3,413,102; 3,539,312 and 3,449,742 all disclose various additives for use in diesel fuels to reduce particulate emissions. These patents show smoke suppressants which are commonly employed in or added to diesel fuel oils. In general, the previously most common smoke suppressants employed in a diesel fuel was an organic compound of barium. Calcium compounds have also been proposed to replace the barium materials previously suggested because of the possibility of the toxicity of the barium.

2. U.S. Pat. No. 4,207,078 discloses a reduction in soot and visible particulate matters from the exhaust of diesel fueled engines by incorporating, within the diesel fuel, an additive consisting of a mixture of an oxygenated compound and an alkyl cyclopentadienyl manganese tricarbonyl.

3. U.S. Pat. No. 4,222,746 discloses the addition of wax oxidates to diesel fuel along with a fuel soluble organometallic compound such as alkyl cyclopentadienyl manganese tricarbonyl complex salts. The combined effect of these two additives reduces the soot and visible particulates emitted from the exhaust of diesel fueled internal combustion engines.

4. U.S. Pat. No. 4,522,631 discloses diesel fuels containing rare earth metals such as cerium octoate and oxygenated compounds such as n-hexyl carbital. However, these fuels are highly unstable upon standing and turn into a deep red, almost black, color which would appear to the consumer to be decomposed. It is a common belief to the general public that dark coloration of a diesel fuel oil is an indication of oil decomposition resulting in malfunctioning in the internal combustion engine.

Thus, the primary object of the instant invention is to stabilize the aforementioned diesel fuel oils.

SUMMARY OF INVENTION

It has now been found that the addition to a diesel fuel of a soluble compound of a rare earth metal, preferably cerium, and an oxygenated compound, reduces the grams per mile of particulates produced by a diesel engine using this fuel, as defined by the EPA, to a much larger degree than the reduction in particulates which occurs by the addition of an equal amount of either of the two additives alone. The synergistic effect of the two additives dramatically reduces particulate emissions in diesel fueled internal combustion engines.

It has also been found that the diesel fuel containing rare earth metal and oxygenated compounds can be color stabilized by the addition of a hindered nitrogenous bis-heterocyclic diester of dibasic acid which diester has a molecular weight of about 200 to about 800 and, preferably, a molecular weight of about 400 to about 600.

PREFERRED EMBODIMENTS OF THE INVENTION

In accordance with the present invention, a diesel fuel is modified by mixing therewith an oxygenated compound and a diesel fuel soluble compound of a rare earth metal, preferably cerium. The rare earth metals that may be used include lanthanum, cerium, praseodymium, neodymium, promethium, samarium, europium, gadolinium, terbium, dysprosium, holmium, erbium, thulium, ytterbium and lutecium. Suitable oxygenated compounds include alkyl carbitols having from about 5 to about 16 carbon atoms such as n-hexylcarbitol, aldehydes and ketones having from about 3 to 16 carbon atoms such as propionaldehyde, acetone, normal alcohols having from about 3 to 16 carbon atoms, and various cyclic and normal ethers having from about 2 to about 16 carbon atoms. In general, enough of the oxygenated compound should be added to the diesel fuel to provide from about 0.0025 to about 1.5 wt.% and, preferably, from about 0.0025 to about 1.0 wt.% of the oxygen in the diesel fuel. Presently, the preferred oxygenated compound is a carbitol and the most preferred carbitol is n-hexylcarbitol.

The rare earth metal compound is preferably an oxygen containing diesel fuel soluble form of the rare earth metals. The preferred rare earth compounds are organometallic compounds containing oxygen. The quantity of the rare earth metal present in the diesel fuel can vary from about 0.001 to about 0.10 wt.% of the diesel fuel. Preferably, the quantity of the rare earth metal varies from about 0.001 to about 0.05 wt.% of rare earth metal in the diesel fuel. The presently most preferred form of the diesel fuel soluble rare earth metal comprises a carbonyl. Suitable rare earth metal carbonyls include rare earth metal salts of alkyl carboxylic acids and of cycloalkyl carboxylic acids which may contain from about 3 to 16 carbon atoms even though larger numers of carbon atoms are also useful. A preferred rare earth metal additive comprises a rear earth octoate which has the following formula:

$$C_7H_{15}-\overset{\overset{\displaystyle O}{\|}}{C}-O-M$$

where M stands for the rare earth metal. Presently, the most preferred rare earth metal is cerium.

The invention also comprises a color stabilizing additive, a bis-nitrogenous heterocyclic diester of a basic acid, which can be represented by the following formulae:

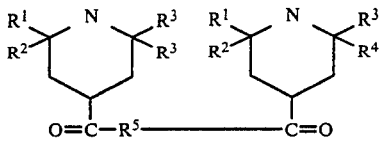

where $R^1$, $R^2$, $R^3$ and $R^4$ can be H, $CH_3$— or $CH_3$—$CH_2$—; and $R^5$ can be $CH_2$—, —$CH_2$—$CH_2$—, —$(CH_2)_3$, —$(CH_2)_4$, —$(CH_2)_5$—, —$(CH_2)_6$—, —$(CH_2)_7$— or —$(CH_2)$—$_8$. Preferably $R^1$, $R^2$, $R^3$ and $R^4$ are equal to $CH_3$ or $CH_3CH_2$— and $R^5$ is $OC_6H_{12}$— to —$C_8H_{16}$—. Most preferably, $R^1$, $R^2$, $R^3$ and $R^4$ are equal to $CH_3$— radicals and $R^5$ is equal to —$C_8H_{16}$—. The instant invention, i.e., a bis-nitrogenous heterocyclic diester of a basic acid, is commercially available under the tradename of Tinuvin 770, generally known as Bis(2,2,6,6-Tetra-Methyl-4-Piperidyl)Sebacate and manufactured by CIBA GEIGY.

The bis-(2,2,6,6-tetramethyl-4-piperidyl)sebacate is added at about 0.00038 wt.% to about 0.038 wt.%.

The invention also comprises a fuel additive concentrate which includes a minor amount of a diesel fuel soluble form of a rare earth metal, preferably cerium, diesel soluble oxygenated compound and a major amount of a diesel fuel composition boiling in the range of about 350° F. to about 750° F.

This fuel concentrate can be added to a diesel fuel composition boiling in the range of about 350° F. to about 740° F. to reduce the particulate emission properties of the diesel fuel. Preferably, the fuel concentrate contains from about 1 wt.% to about 50 wt.% of the rare earth metal compound, whose composition is given in the previous paragraphs. Further, the fuel concentrate preferably contains from about 10.0 wt.% to about 80.0 wt.% of the oxygenated compound whose composition is given above. Preferably, the final concentrate contains from about 3.0 wt.% to about 39.0 wt.% of disaster.

The cerium octoate and n-hexylcarbitol additives package changes the color of diesel fuels stored at 85 F. from amber to dark red.

According to the present invention, it discloses the use of a bis(2,2,6,6-tetramethyl-4-piperidyl)sebacate to improve the color stability of the test fuel mixture in a long-term storage. The results are shown below in Table I.

TABLE I

STORAGE RESULTS (8-weeks @ 85° F.)

| Fuel | Appearance | Deposit |
|---|---|---|
| Base Fuel | Yellow-Orange | Moderate |
| Base Fuel + 210 ppm cerium octoate + 200 ppm N—hexylcarbitol | Dark Red | Heavy |
| Base Fuel + 210 ppm cerium octoate + 200 ppm N—hexylcarbitol + 20 PTB Instant Invention | Light Red | Trace |

The test procedure, reagents and apparatus for treating a dark colored fuel are described below.

METHOD OF TEST FOR 85° F. STORAGE TEST FOR MIDDLE DISTILLATE FUELS

Outline of Method

The fuel sample is stored in a vented quart bottle, with light excluded, at a temperature of 85° F. The samples are analyzed every 7 days and the appearance is recorded.

Apparatus

A. Oven—capable of maintaining a temperature of 85±1° F.

B. Bottle—of clear, soft glass, one quart size, narrow mouth and fitted with a No. 9 cork.

C. Capillary Glass Tubing—2 mm I.D. tubing, 3 inches in length and bent in the shape of the numeral 7.

Reagents

A. N-Heptane, regular grade.

Procedure

A. Filter 500 ml of the fuel to be tested into the one-quart narrow-mouth bottle through a 15 cm No. 1 Whatman filter paper. Insert a piece of 2 mm I.D. glass capillary tubing (bent approximately in the shape of the numeral 7) through the cork into the one-quart bottle. This bottle shall have been previously cleaned with chromic acid cleaning solution, rinsed three times with distilled water, rinsed with acetone and air-dried. Place the bottle in an oven, preheated to 85° F.

B. Every 7 days, remove the bottle from the oven and record its appearance (color, sediment).

I claim:

1. A middle distillate fuel oil composition characterized by improved color stability which comprises a major portion of a middle distillate fuel oil; and a minor effective portion of an additive mixture consisting of:

(a) a bis-nitrogenous heterocyclic diester of a dibasic acid having a molecular weight of about 200 to about 800 and of the formula

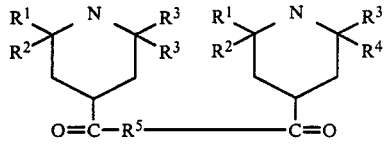

where $R^1$, $R^2$, $R^3$ and $R^4$ each are H, $CH_3$— OR $CH_3$—$CH_2$—; and $R^5$ is $CH_2$—, —$CH_2$—$CH_2$—, —$(CH_2)_3$, —$(CH_2)_4$, —$(CH_2)_5$—, —$(CH_2)_6$—, —$(CH_2)_7$— or —$(CH_2)$—$_8$;

(b) a rate earth metal salt of a ($C_3$–$C_{25}$) fatty acid; and (c) an ($C_3$–$C_{16}$) alkyl carbitol.

2. The fuel oil composition of claim 1, wherein said bis-nitrogenous heterocyclic diester is bis(2,2,6,6-tetramethyl-4-piperidyl)sebacate.

3. The fuel oil composition of claim 1, wherein said rare metal salt is cerium octoate.

4. The fuel oil composition of claim 1, wherein said carbitol is n-hexylcarbitol.

5. The fuel oil composition of claim 1, wherein said bis-nitrogenous heterocyclic diester is present in an amount of about 0.00038 wt.% to about 0.038 wt.% and said rare earth metal salt is present in the amount of about 0.001 wt.% to about 0.5 wt.% of said fuel and said alkyl carbitol provides from about 0.0025 to about 1.0 wt.% of oxygen in said diesel fuel.

6. The fuel oil composition of claim 5, wherein said bis-nitrogenous heterocyclic diester is bis(2,2,6,6-tetramethyl-4-piperidyl)sebacate, said metal salt is cerium octoate and said alkyl carbitol is n-hexyl carbitol.

7. The fuel composition of claim 1, wherein the diester $R^1$, $R^2$, $R^3$ and $R^4$ are each $CH_3$ or $CH_3CH_2$— and $R^5$ is $C_6H_{12}$— to —$C_8H_{16}$—.

8. A middle distillate fuel additive concentrate comprising (a) a minor amount of a diesel fuel composition boiling in the range of from about 350° F. to about 750° F.; and (b) a major amount of bis(2,2,6,6-tetramethyl-4-piperidyl)sebacate which has a molecular weight of about 400 to about 600 and consists of:

(i) a cerium salt of an acid selected from the group consisting of carboxylic acids and cycloalkyl carboxylic acids having from about 3 to about 16 carbon atoms; and (ii) an ($C_3$–$C_{16}$) alkyl carbitol.

* * * * *